US011753269B2

(12) United States Patent
Asakawa

(10) Patent No.: US 11,753,269 B2
(45) Date of Patent: Sep. 12, 2023

(54) POST-PROCESSING APPARATUS AND IMAGE FORMING SYSTEM

(71) Applicant: KONICA MINOLTA, INC., Tokyo (JP)

(72) Inventor: Minoru Asakawa, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 17/752,781

(22) Filed: May 24, 2022

(65) Prior Publication Data

US 2022/0380163 A1 Dec. 1, 2022

(30) Foreign Application Priority Data

Jun. 1, 2021 (JP) ..... 2021-092046

(51) Int. Cl.
*B65H 35/02* (2006.01)
*B65H 35/00* (2006.01)
*B65H 43/08* (2006.01)

(52) U.S. Cl.
CPC ..... *B65H 35/0093* (2013.01); *B65H 43/08* (2013.01); *B65H 2701/1914* (2013.01); *B65H 2801/27* (2013.01)

(58) Field of Classification Search
CPC .. B65H 43/08; B65H 2701/1914; B41F 13/56
USPC ..... 270/30.08, 52.17
See application file for complete search history.

(56) References Cited

U.S. PATENT DOCUMENTS 5,790,168 A * 8/1998 Sano ..... B65H 35/02 347/262
6,914,688 B2 * 7/2005 Inana ..... B65H 35/0066 358/1.12
6,930,802 B2 * 8/2005 Sugaya ..... B65H 20/32 358/1.9
8,181,556 B2 * 5/2012 Brandenburg ..... B65H 23/1882 83/13
8,446,629 B2 * 5/2013 Ishibashi ..... G06F 3/1243 399/385
8,773,738 B2 * 7/2014 Toki ..... B65H 7/20 271/227
9,162,484 B2 * 10/2015 Hoshino ..... B65H 35/0086
9,469,129 B2 * 10/2016 Suzuki ..... B26D 5/32
2010/0028066 A1 * 2/2010 Thomson ..... B26D 5/086 400/621

FOREIGN PATENT DOCUMENTS

JP 2018-180228 A 11/2018

* cited by examiner

*Primary Examiner* — Leslie A Nicholson, III
(74) *Attorney, Agent, or Firm* — Squire Patton Boggs (US) LLP

(57) ABSTRACT

A post-processing apparatus that performs post-processing on paper in which an image is formed, the apparatus including: a paper cutter that cuts the paper in which the image is formed; a reader that reads the paper cut by the paper cutter; and a hardware processor that determines whether a cutting position of the paper cut by the paper cutter is good or not based on a read result read by the reader, wherein the hardware processor determines whether the cutting position of the paper in which partial cutting is performed is good or not, the partial cutting being cutting a portion of the paper by the paper cutter.

7 Claims, 7 Drawing Sheets

POST-PROCESSING APPARATUS AND IMAGE FORMING SYSTEM

CROSS-REFERENCE TO RELATED APPLICATIONS

The entire disclosure of Japanese Patent Application No. 2021-092046 filed on Jun. 1, 2021 is incorporated herein by reference in its entirety.

BACKGROUND

Technological Field

The present invention relates to a post-processing apparatus and an image forming system including such post-processing apparatus.

Description of the Related Art

Conventionally, there is a known image forming system including an image forming apparatus that forms an image on paper, and a post-processing apparatus that performs post-processing on the paper in which the image is formed by the image forming apparatus. For example, as a well-known post-processing apparatus, there is a post-processing apparatus that includes a paper cutter that cuts the paper in which the image forming apparatus formed the image.

In the post-processing apparatus including the paper cutter, when small pieces are made by performing a cutting process on the same paper in a main scanning direction many times such as when the paper is cut to make business cards, cutting processes are sequentially performed with cutting processing parameters (moving time, number of moving steps) with the front tip of the paper before cutting being used as the reference.

Cutting is performed a plurality of times by repeatedly performing the following steps, "conveying the paper", "stopping the paper", "cutting the paper", "conveying the paper again", "stopping the paper", "cutting the paper", and so on. Here, in the step "conveying the paper again", because of the slip of the driving roller due to the paper type, a slight difference from the target moving amount occurs. Such difference in the moving amount gradually accumulates with the number of times that the cutting is performed. As a result, paper piece cutting positions tend to be displaced from the proper position. That is, when the cut pieces are compared from the beginning to the end after a plurality of cuts on the paper, the cut size may be different from the set size. FIG. 11 shows an example of how the cut positions are displaced from the proper positions. The sign P in FIG. 11 shows the paper, the sign Q1 (solid line) shows the proper position (target position), and the sign R1 (broken line) shows the actual cut position.

In view of such accumulated displacement of the moving amount, there is a known function in which the displaced amount is corrected and the job is performed by a function in which each cutting position is adjusted in advance. However, the reason for the variation in the moving amount which causes the displacement includes conditions such as paper type and the number of times that the cutting is performed. Therefore, the conditions of the displacement changes depending on the paper that is used in the job to be performed or the contents of the job. Consequently, the cutting positions need to be adjusted in advance for each job, and the burden is heavy for the user.

In view of the above, JP 2018-180228 discloses a configuration in which the image on the paper is read after the cutting process and it is determined whether or not the cutting process (cutting position) is properly performed.

SUMMARY

However, according to the configuration described in JP 2018-180228, a reading apparatus is used when the paper after the cutting process is read, and such reading device is connected so as to perform reading in a later process in the cutting apparatus. However, when the cutting process is a job in which many small pieces of paper are created, a dedicated conveying mechanism needs to be provided in order to stably convey the small pieces to the reading apparatus connected to perform the latter process. This requires high costs. If a dedicated conveying mechanism is not provided, the small pieces cannot be conveyed to the reading apparatus, and are stored in a dedicated stacking area in the cutting apparatus. Therefore, it is not possible to read the image after the cutting process in which many small pieces are created.

If the image reading after the cutting process in which many small pieces are created is performed manually by the user, the separate small pieces need to be placed one by one in the image reading position. This requires an excessive burden.

The purpose of the present invention is to provide a post-processing apparatus in which the quality of the paper after cutting can be checked easily and without a hassle even after creating many small pieces of paper such as cutting to make business cards, and an image forming system including such post-processing apparatus.

To achieve at least one of the abovementioned objects, according to an aspect of the present invention, a post-processing apparatus that performs post-processing on paper in which an image is formed, reflecting one aspect of the present invention includes: a paper cutter that cuts the paper in which the image is formed; a reader that reads the paper cut by the paper cutter; and a hardware processor that determines whether a cutting position of the paper cut by the paper cutter is good or not based on a read result read by the reader, wherein the hardware processor determines whether the cutting position of the paper in which partial cutting is performed is good or not, the partial cutting being cutting a portion of the paper by the paper cutter.

According to another aspect, an image forming system includes: an image former that forms an image on paper; and the above-described post-processing apparatus that performs post-processing on the paper in which the image is formed by the image former.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, wherein.

DETAILED DESCRIPTION OF THE EMBODIMENTS

Hereinafter, embodiments of the present invention are described in detail with reference to the drawings.

Figure 1:
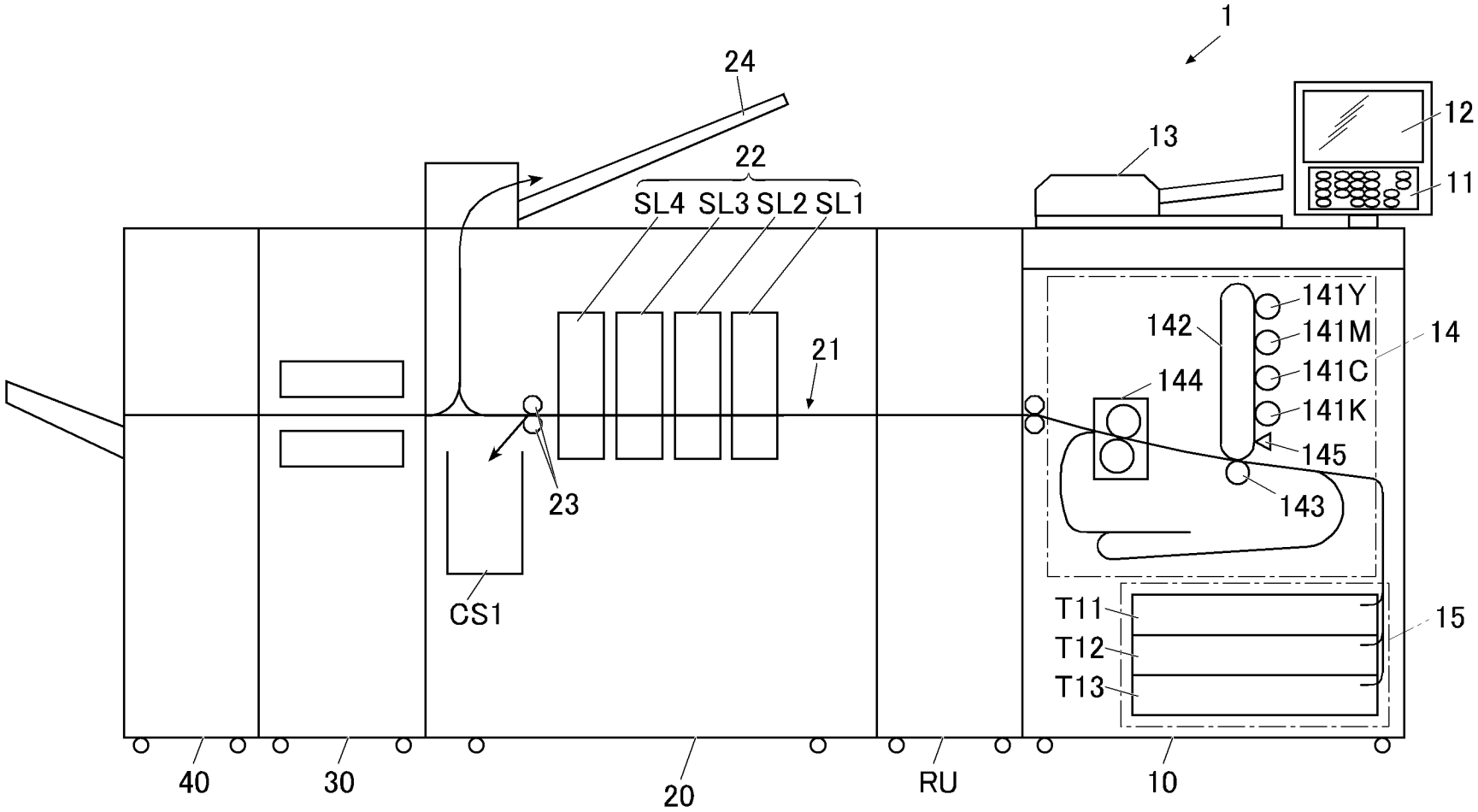
FIG. 1 is a diagram showing a schematic configuration of an image forming system according to the present embodiment.
Figure 2:
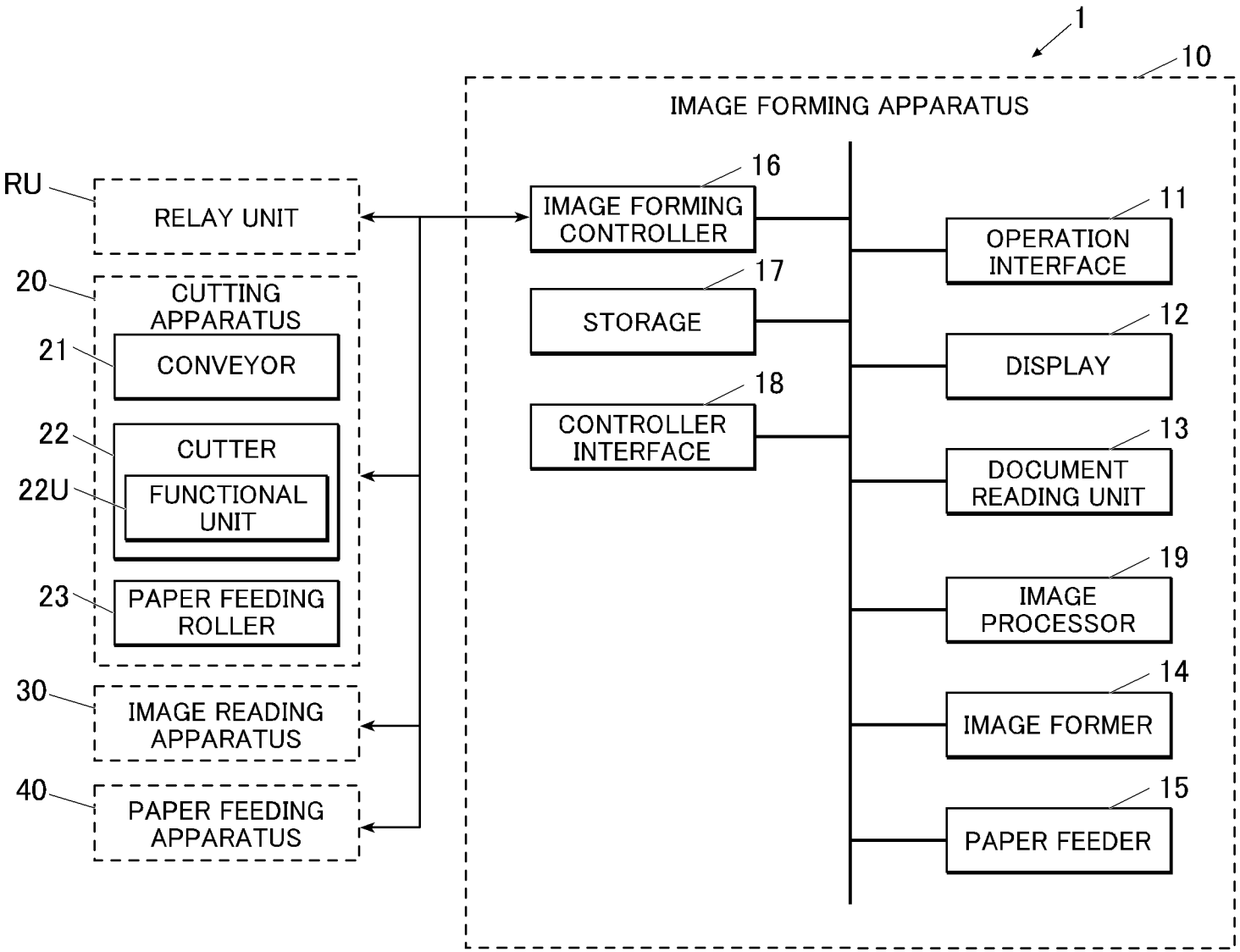
FIG. 2 is a functional block diagram showing a control configuration of the image forming system according to the present embodiment.

As shown in FIG. 1 and FIG. 2, an image forming system 1 according to the present embodiment includes an image forming apparatus 10, a relay unit RU, a cutting apparatus 20, and an image reading apparatus 30 which are included in a post-processing apparatus, and a paper ejecting apparatus 40.

The image forming apparatus 10 forms a color image by an electrophotographic method based on image data obtained by reading an image from a document or image data received from an external device. The paper on which an image is formed is ejected to the relay unit RU.

As shown in FIG. 1 and FIG. 2, the image forming apparatus 10 includes an operation interface 11, a display 12, a document reading unit 13, an image former 14, a paper feeder 15, an image forming controller (hardware processor) 16, a storage 17, a controller interface 18, and an image processor 19.

The operation interface 11 includes a touch panel formed to cover a display screen of the display 12, and various operation buttons such as numeric buttons, a start button, etc. The operation interface 11 outputs the operation signal according to the operation by the user to the image forming controller 16.

The display 12 includes a liquid crystal display (LCD), and displays various screens according to an instruction of a display signal input from the image forming controller 16.

The document reading unit 13 includes an automatic document feeder, a scanner, etc. The document reading unit 13 outputs the image data obtained by reading the image of the document to the image forming controller 16.

The image former 14 forms an image on paper supplied from a paper feeder 15 based on the image data on which image processing is performed by the image processor 19.

The image former 14 includes photosensitive drums 141Y, 141M, 141C, 141K corresponding to each color of yellow (Y), magenta (M), cyan (C), and black (K), an intermediate transfer belt 142, a secondary transfer roller 143, a fixer 144, and the like.

The photosensitive drum 141Y is uniformly charged and then scanned and exposed by a laser beam based on image data in the color yellow. With this, an electrostatic latent image is formed. Then, yellow toner is attached to the electrostatic latent image on the photosensitive drum 141Y and the image is developed.

The photosensitive drums 141M, 141C, and 141K are the same as the photosensitive drum 141Y other than the color, and therefore the description is omitted.

The toner images formed on the photosensitive drums 141Y, 141M, 141C, 141K are sequentially transferred on the rotating intermediate transfer belt 142 (primary transfer). That is, a color toner image in which toner images in four colors are overlapped is formed on the intermediate transfer belt 142.

The color toner image on the intermediate transfer belt 142 is transferred collectively on the paper by the secondary transfer roller 143 (secondary transfer).

The fixer 144 includes a heating roller that heats paper on which the color toner image is transferred and a pressing roller that presses on the paper, and the color toner image is fixed on the paper by heating and pressing.

The paper feeder 15 includes paper feeding trays T11 to T13 and the paper is supplied to the image former 14. The paper feeding trays T11 to T13 store paper with a paper type and size predetermined for each paper feeding tray.

The image forming controller 16 includes a CPU, a ROM, a memory, and the like.

The CPU reads various processing programs stored in the ROM and centrally controls the operations of each unit in the image forming apparatus 10 according to the program. When the cutting process is performed on the output paper, the CPU outputs an instruction to perform the predetermined cutting process to the cutting apparatus 20.

The ROM includes a non-volatile semiconductor memory and stores various processing programs, parameters and files necessary to execute the programs, and the like.

The memory includes a dynamic random access memory (DRAM) and temporarily stores various data such as programs, image data regarding various image processes and the like.

For example, based on the result of reading by the image reading apparatus 30, the image forming controller 16 functions as a determiner that determines whether the cutting position of the paper cut by the cutter 22 is good or bad.

For example, the image forming controller 16 functions as an executor that executes jobs.

The image forming controller 16 functions as a cutting controller that controls cutting of the paper by the cutter 22.

The storage 17 is a non-volatile storage apparatus such as a hard disk drive (HDD), semiconductor memory, and the like for storing programs and various data such as image data. The storage 17 stores data such as program data and various setting data in a readable and writable format according to control from the image forming controller 16.

For example, the storage 17 stores an adjustment value of a control parameter (cutting position, etc.) related to a business card creating job. For example, such adjustment value may be a new correction adjustment value created based on a read result read by the image reading apparatus 30 and stored as an existing correction adjustment value.

The controller interface 18 receives image data input from the external device.

The image processor 19 performs the necessary image processing on the image data stored in the storage 17, the image data obtained by reading the image from the document with the document reading unit 13, and the image data input from the external apparatus. After the image processing is performed on the image data, the image data is transmitted to the image former 14. The image processing includes gradation processing, halftone processing, color conversion processing, and the like. The gradation processing is a process in which a gradation value of each pixel in the image data is converted to a corrected gradation value so that a density characteristic of the image formed on the paper matches the target density characteristic. The halftone processing is error diffusion processing, screen processing by ordered dithering or the like. The color conversion processing is a process that converts gradation values of RGB to gradation values of CMYK.

The relay unit RU is provided between the image forming apparatus 10 and the cutting apparatus 20 and includes the function to synchronize with the conveying speed of the paper conveyed from the image forming apparatus 10.

The cutting apparatus 20 is an apparatus that performs cutting processes as necessary on the paper output from the relay unit RU. The cutting process is not required and the cutting apparatus 20 only performs the cutting process when there is an instruction from the image forming apparatus 10. When there is no cutting process, the cutting apparatus 20 conveys the conveyed paper as is to the image reading apparatus 30.

As shown in FIG. 1, the cutting apparatus 20 includes a conveyor 21, a cutter 22, a paper ejecting roller 23 that ejects the paper cut in a business card/card size by the cutter 22 to a business card stacker CS1, and a sub-tray 24 loading purged paper from the cutting apparatus 20.

The conveyor 21 conveys the paper conveyed from the relay unit RU to the cutter 22 and conveys the paper in which the cutting process is performed by the cutter 22 to the sub-tray 24 or the image reading apparatus 30.

The cutter (paper cutter) 22 performs cutting processes on the conveyed paper using a plurality of functional units. The cutter 22 includes a plurality of slots SL 1 to SL 4 (four in the present embodiment) to load the functional unit. According to the present embodiment, a unit to perform vertical slit processing is provided in a slot SL 1 which is positioned most upstream in the conveying direction, units to perform bleed cut slit processing are provided in a slot SL 2 and a slot SL 3, and a unit to perform a CD cutting process is provided in a slot SL 4 which is positioned most downstream. By combining the above, cutting is performed a plurality of times to create business cards. By suitably changing the combination of the functional units, cutting and paper processing other than for making business cards can be performed, examples including four-side cutting, dividing cutting, creasing, and perforating.

The paper ejecting roller 23 is positioned right after the slot SL 4 that is most downstream.

Figure 3A:
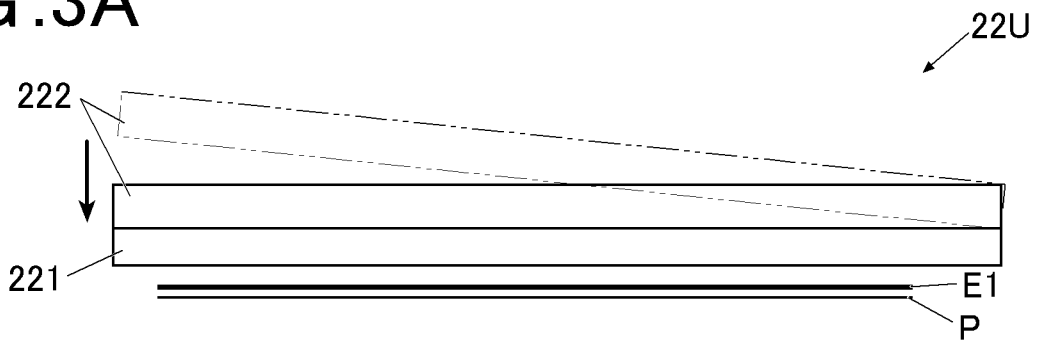
FIG. 3A and FIG. 3B are side views showing the configuration of a cutter.
Figure 3B:
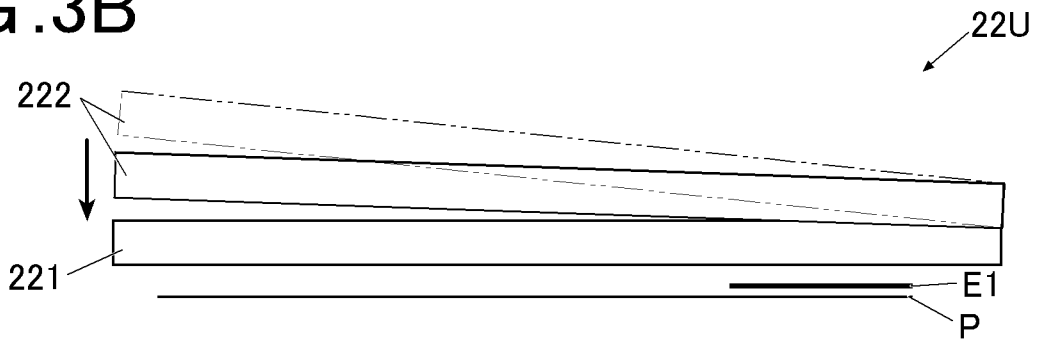

As shown in FIG. 3A and FIG. 3B, the functional units 22U included in the cutter 22 include a lower cutting blade 221 that comes into contact with the paper P when cutting is performed, and an upper cutting blade 222 that presses the lower cutting blade 221 from above to adjust the region of contact (contact amount) with the paper P of the lower cutting blade 221.

The upper cutting blade 222 is supported by an axis at one end (right end in figure) in the cutting direction so as to be able to rotate, and a contact region in which the lower cutting blade 221 is in contact with the paper P is adjusted according to a rotated amount.

When the entire surface is cut, as shown in FIG. 3A, the entire upper cutting blade 222 comes into contact with the lower cutting blade 221 in the cutting direction so that the entire lower cutting blade 221 comes into contact with the paper P in the cutting direction.

Alternatively, when partial cutting in which a portion of the paper P is cut, as shown in FIG. 3B, a portion of the upper cutting blade 222 comes into contact with the lower cutting blade 221 in the cutting direction so that a portion of the lower cutting blade 221 comes into contact with the paper P in the cutting direction.

As described above, by adjusting the rotated amount of the upper cutting blade 222, the region of contact that the lower cutting blade 221 comes into contact with the paper Pin the cutting direction can be adjusted. Therefore, the cutting region (refer to reference symbol E1 in the drawing) of the paper P can be adjusted.

Figure 4:
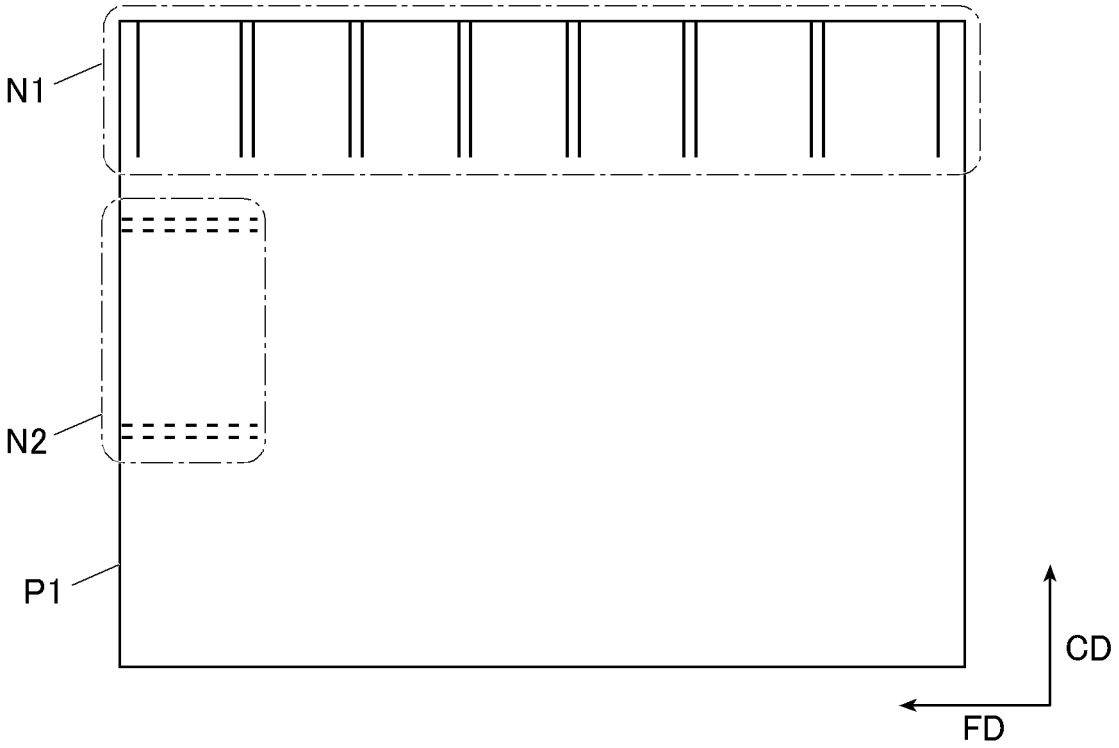
FIG. 4 is a diagram showing an example of paper in which partial cutting is performed.

FIG. 4 shows one example of the paper P1 in which partial cutting is performed.

According to the present embodiment, even if the job (business card creating job, etc.) is set to cut the paper in both the conveying direction of the paper (FD direction) and the direction orthogonal to the conveying direction (CD direction), the partial cutting is performed only in a main scanning direction (direction orthogonal to a conveying direction: CD direction) (refer to reference symbol N1 in the drawing). This is because the cutting in the sub-scanning direction (conveying direction: FD direction) may cause failure in conveying the paper to devices that perform later processes. Even if the direction is the sub-scanning direction, if the cutting is partial cutting with a small length (for example, partial cutting of only a first line), the risk of failure in conveying occurring can be reduced, and it is possible to perform partial cutting (refer to reference symbol N2 in drawing).

The image reading apparatus 30 is connected to be used after the cutting apparatus 20. For example, the image reading apparatus 30 includes a linear image sensor (for example, a CCD line sensor, etc.), an optical system, a light source, and the like. The image reading apparatus 30 reads the paper cut by the cutter 22, and outputs the obtained read image to the image reading controller 16 of the image forming apparatus 10. That is, the image reading apparatus 30 functions as a reader of the present invention.

The paper ejecting apparatus 40 is connected to be used after the image reading apparatus 30. The paper ejecting apparatus 40 ejects the paper conveyed from the image reading apparatus 30 outside the apparatus.

Figure 5:
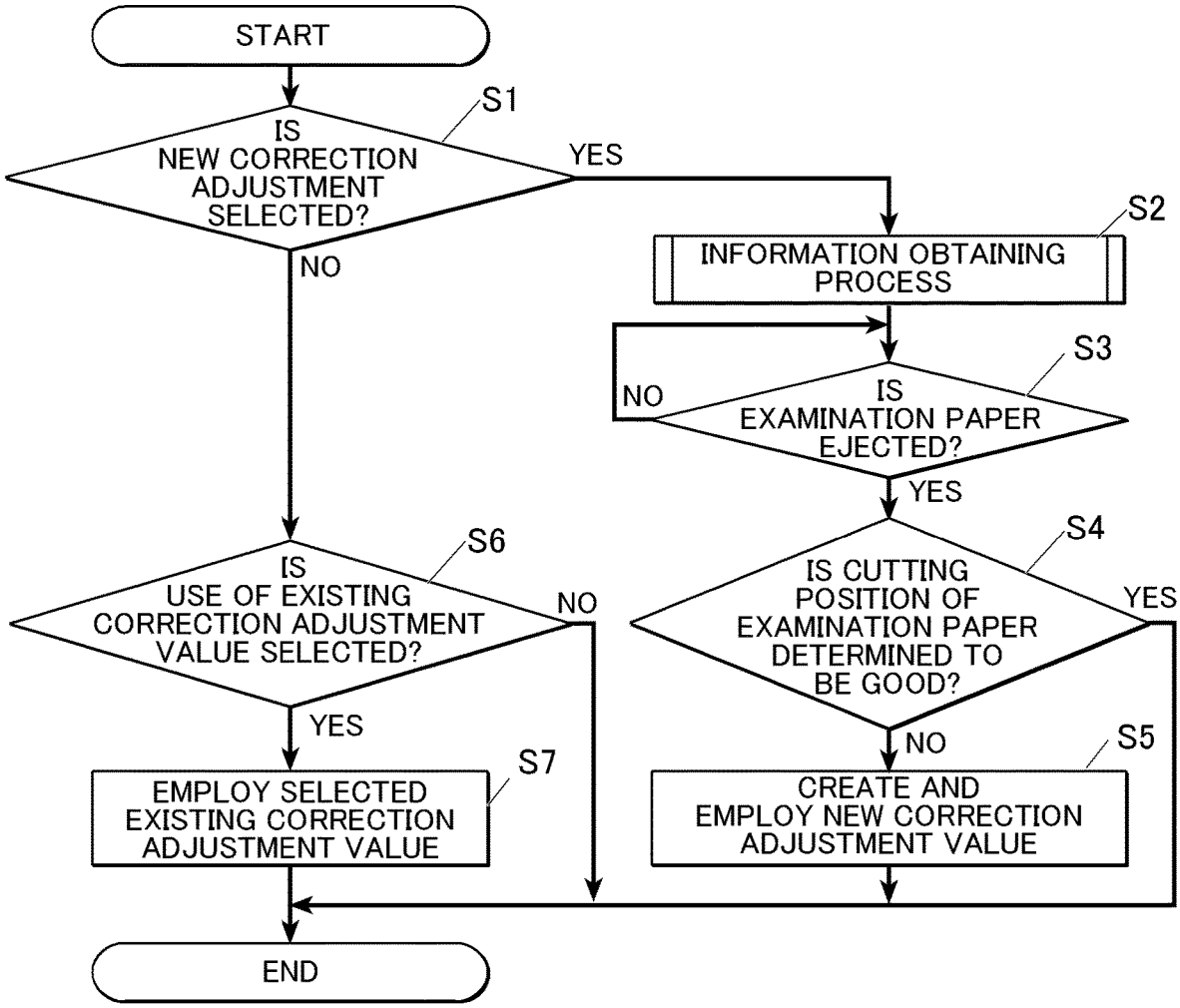
FIG. 5 is a flowchart showing an example of an operation of the image forming system according to the present embodiment.

Next, the operation of the image forming system 1 according to the present embodiment is described with reference to the flowchart shown in FIG. 5. The operation shown in FIG. 5 is performed before starting the business card creating job. The business card creating job is a job in which one sheet of paper is cut a plurality of times in a conveying direction of the paper (FD direction) and a direction orthogonal to the conveying direction (CD direction), many pieces of paper cut in the same size are created, and the pieces of paper are ejected.

First, the image forming controller 16 determines whether a new correction adjustment is selected by the user (step S1). In the new correction adjustment, a misalignment of the cutting position in the default adjustment value is obtained, the adjustment value (new correction adjustment value) to correct the misalignment is newly obtained and the obtained adjustment value is employed and the cutting position of the paper is corrected (adjusted).

Figure 6:
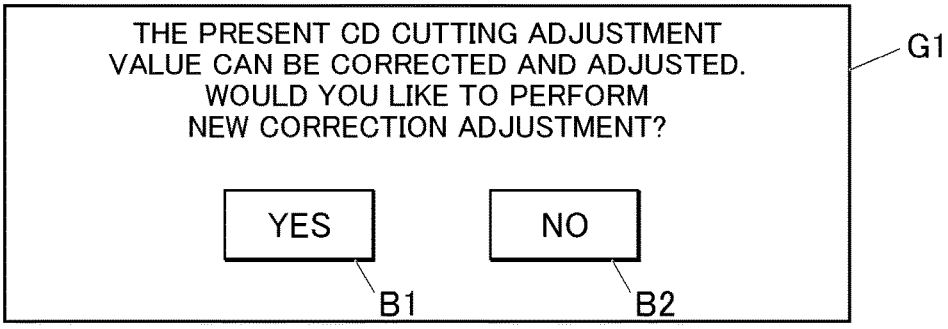
FIG. 6 is a diagram showing an example of a new correction adjustment selection screen.

FIG. 6 shows an example of a new correction adjustment selection screen G1 to select the new correction adjustment. The new correction adjustment selection screen G1 is displayed on the display 12 when the start operation of the business card creating job is performed.

In the new correction adjustment selection screen G1, a YES button B1 to select the new correction adjustment and a NO button B2 to select other adjustment are provided. In step S1, the image forming controller 16 determines that the new correction adjustment is selected when it is detected that the user pressed the YES button B1.

When the image forming controller 16 determines that the new correction adjustment is selected (step S1: YES), the process proceeds to the next step S2.

When the image forming controller 16 determines that the new correction adjustment is not selected (step S1: NO), the process proceeds to step S6.

In step S2, the image forming controller 16 performs an information obtaining process. The information obtaining process is a process to obtain information necessary to create the new correction adjustment value (partial cutting position). Below, the information obtaining process is described with reference to the flowchart shown in FIG. 7.

First, the image forming controller 16 feeds and conveys specified paper (paper specified in advance to be used in the new correction adjustment) (step S21).

Next, the image forming controller 16 creates partial cutting paper (examination paper) in which the specified paper conveyed in step S21 is partially cut at the default adjustment value by the cutter 22 (step S22).

Next, the image forming controller 16 uses the image reading apparatus 30 to read the partial cutting position of the examination paper created in step S22 (step S23). The information read in step S23 (read result) is notified to the image forming controller 16. Then, the examination paper in which the partial cutting position is read in step S23 is ejected outside the apparatus by the paper ejecting apparatus 40.

Figure 7:
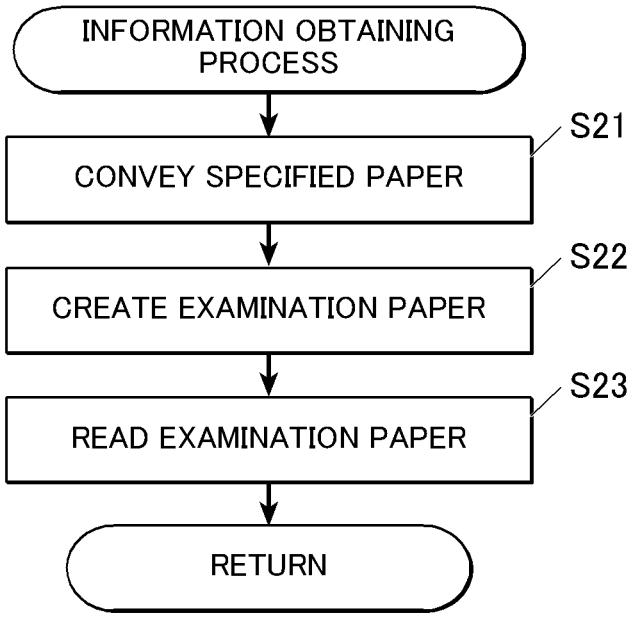
FIG. 7 is a flowchart showing an example of an information obtaining process.

Returning to FIG. 5, in step S3, the image forming controller 16 determines whether the examination paper in which the partial cutting position is read in step S23 in FIG. 7 is ejected outside the apparatus by the paper ejecting apparatus 40. Specifically, when it is determined that the information showing that the ejection is finished is notified from the paper ejecting apparatus 40, the image forming controller 16 determines that the paper is ejected outside the apparatus by the paper ejecting apparatus 40.

When it is determined that the paper is ejected outside the apparatus by the paper ejecting apparatus 40 (step S3: YES), the image forming controller 16 proceeds the process to the next step S4.

When it is determined that the paper is not ejected outside the apparatus by the paper ejecting apparatus 40 (step S3: NO), the image forming controller 16 repeats the process in step S3, until the paper is ejected outside the apparatus.

In step S4, The image forming controller 16 determines whether the cutting position of the paper in which the partial cutting is performed by the cutter 22 (examination paper) is good or not good based on a read result read in step S23 in FIG. 7. The image forming controller 16 determines that the result is good when the misalignment of the cutting position of the examination paper is within an acceptable range, and that the result is not good when the misalignment is outside the acceptable range.

When it is determined that the cutting position of the examination paper is good (step S4: YES), the image forming controller 16 determines that there is no need to perform the correction and ends the process. The job is started by employing the default adjustment value without creating the new correction adjustment value.

When it is determined that the cutting position of the examination paper is not good (step S4: NO), the image forming controller 16 proceeds the process to the next step S5.

In step S5, the image forming controller 16 creates the new correction adjustment value based on the read results read in step S23 in FIG. 7, and the new correction adjustment value is employed (set). Specifically, the image forming controller 16 creates the new correction adjustment value with relation to the default adjustment value from the difference between the suitable cutting position and the read result. The image forming controller 16 employs the new correction adjustment value and corrects (adjusts) the cutting position of the paper. The new correction adjustment value created in step S5 is stored in the storage 17. In the process in step S5, based on the determination result by the determiner, the image forming controller 16 functions as the adjuster that adjusts the cutting position.

In step S6, the image forming controller 16 determines whether the use of the existing correction adjustment value is selected by the user. The existing correction adjustment value is the new correction adjustment value created in the past.

Figure 8:
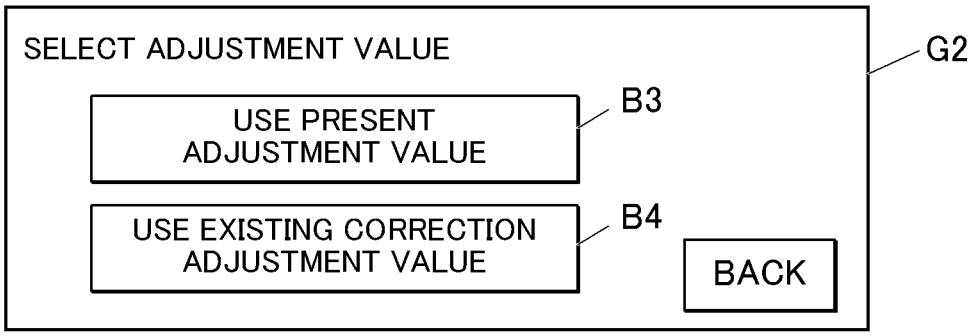
FIG. 8 is a diagram showing an example of an existing correction adjustment value use selection screen.

FIG. 8 shows an example of an existing correction adjustment value use selection screen G2 for selecting whether to use the existing correction adjustment value or the present adjustment value. The existing correction adjustment value use selection screen G2 is displayed on the display 12 when it is detected that the user pressed the NO button B2 on the new correction adjustment selection screen G1 (see FIG. 6).

In the existing correction adjustment value use selection screen G2, a "use present adjustment value button B3" for selecting the use of the present adjustment value and a "use existing correction adjustment value button B4" for selecting the use of the adjustment value (existing correction adjustment value) stored in the storage 17 are provided. In step S6, when it is detected that the user pressed the "use existing correction adjustment value button B4", the image forming controller 16 determines that the use of the existing correction adjustment value is selected.

When it is determined that the use of the existing correction adjustment value is selected (step S6: YES), the image forming controller 16 proceeds the process to the next step S7.

When the image forming controller 16 determines that the use of the existing correction adjustment value is not selected (that is, it is detected that the "use present adjustment value button B3" is pressed) (step S6: NO), the image forming controller 16 determines that the use of the present adjustment value is selected and ends the process. With this, the job is started maintaining the present adjustment value (adjustment value set at present).

In step S7, the image forming controller 16 employs (sets) the existing correction adjustment value selected by the user.

Figure 9:
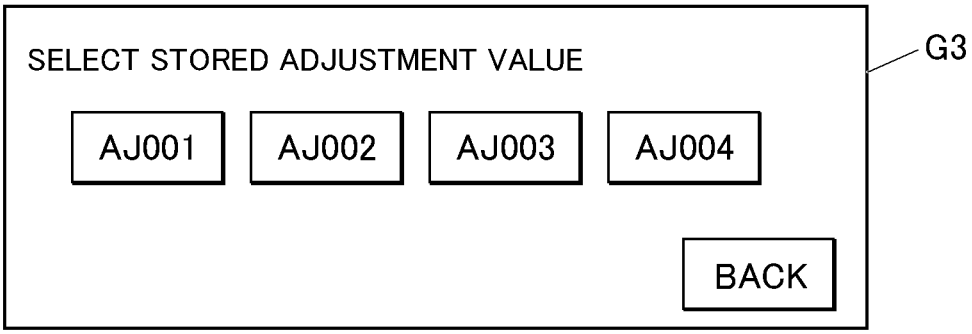
FIG. 9 is a diagram showing an example of an existing correction adjustment value selection screen.

FIG. 9 shows an example of the existing correction adjustment value selection screen G3 for selecting the desired existing correction adjustment value from the existing correction adjustment values stored in the storage 17. The existing correction adjustment value selection screen G3 is displayed on the display 12 when it is detected that the user pressed the "use existing correction adjustment value button B4" on the existing correction adjustment value use selection screen G2 (see FIG. 8).

The existing correction adjustment value stored in the storage 17 is displayed as a list on the existing correction adjustment value selection screen G3. In the example shown in FIG. 9, four existing correction adjustment values "AJ001", "AJ002", "AJ003", and "AJ004" are displayed as a list. The user is able to select the desired existing correction adjustment value from the existing correction adjustment value displayed on the existing correction adjustment value selection screen G3. Then, the image forming controller 16 employs the existing correction adjustment value selected by the user and corrects (adjusts) the cutting position of the paper.

After the cutting position is adjusted by the above process, the image forming controller 16 performs the job in which the adjustment of the cutting position is reflected.

As described above, the image forming system 1 according to the present embodiment includes, the paper cutter (cutter 22) that cuts the paper in which the image is formed, the reader (image reading apparatus 30) that reads the paper cut by the paper cutter, and the determiner (image forming controller 16) that determines whether the cutting position of the paper cut by the paper cutter is good or not based on the read result by the reader. The determiner determines whether the cutting position is good or not in the paper in which partial cutting in which the paper is cut partially by the paper cutter is performed.

Therefore, according to the image forming system 1 of the present embodiment, the paper in which the partial cutting is performed (paper in a state in one sheet not completely cut by the cutting processes) can be read. Therefore, even if the image reading is performed manually by the user, the paper still in one piece (paper not cut into separate pieces) can be read by only placing such one piece of paper in the image reading position. Therefore, even if many small pieces of paper are to be created such as when cutting is performed to make business cards, it is possible to confirm the quality after cutting the paper easily and without hassle.

According to the image forming system 1 of the present embodiment, the reader is positioned downstream of the paper cutter.

Therefore, according to the image forming system 1 of the present embodiment, the paper in which the partial cutting is performed (paper in one piece) can be conveyed stably to the reader connected so that the process is performed after the paper cutter. Therefore, it is possible to read the paper in which the partial cutting is performed in the line of the processes in the apparatus. With this, even in the process of creating many small pieces of paper such as cutting paper for business cards, the confirmation of the quality of the paper after cutting can be performed easily and without a hassle at a low cost without providing a dedicated conveying mechanism.

The image forming system 1 according to the present embodiment includes the adjuster (image forming controller 16) that adjusts the cutting position based on the result determined by the determiner.

Therefore, according to the image forming system 1 of the present embodiment, the paper in which partial cutting is performed can be read and the information of the partial cutting positions can be obtained. With this, the (new correction) adjustment value can be created from the obtained information regarding the partial cutting positions, and the cutting position of the paper can be suitably corrected (adjusted).

The image forming system 1 according to the present embodiment includes the job performer (image forming controller 16). When the job to cut the paper is set, the determiner determines whether the cutting position is good or not before the job is performed, the adjuster adjusts the cutting position before the job is performed, and the performer performs the job in which the adjustment of the cutting position by the adjuster is reflected.

Therefore, according to the image forming system 1 of the present embodiment, the misalignment of the cutting position can be corrected (adjuster) before performing the job, and the accurate cutting process can be performed when the job is executed.

According to the image forming system 1 of the present embodiment, the job in which the paper is cut includes a business card creating job in which one piece of paper is cut a plurality of times in the conveying direction of the paper and the direction orthogonal to the conveying direction and many pieces of paper cut in the same size are created.

Therefore, according to the image forming system 1 of the present embodiment, even in the business card creating job in which many small pieces of paper are created, the paper in a state of one piece (paper not separated) can be read by only placing the paper in one piece on the image reading position. Therefore, the quality of the paper after cutting can be confirmed easily and without hassle.

The image forming system 1 according to the present embodiment includes the cutting controller (image forming controller 16) that controls the cutting of the paper by the paper cutter, and the cutting controller performs partial cutting in only one of two directions (in the present embodiment, the direction orthogonal to the conveying direction of the paper main scanning direction) when the job is set to cut in both the paper conveying direction and the direction orthogonal to the conveying direction and when the partial cutting of the paper is performed by the paper cutter.

Therefore, according to the image forming system 1 of the present embodiment, the direction in which the partial cutting is performed is limited to either one direction between the conveying direction of the paper or the direction orthogonal to the conveying direction. Therefore, the risk of causing difficulties in conveying to apparatuses performing later processes can be decreased.

Although an embodiment of the present invention is described specifically above, the embodiments of the present invention are not limited to the above, and various modifications are possible without leaving the scope of the invention.

Modification 1

Figure 10:
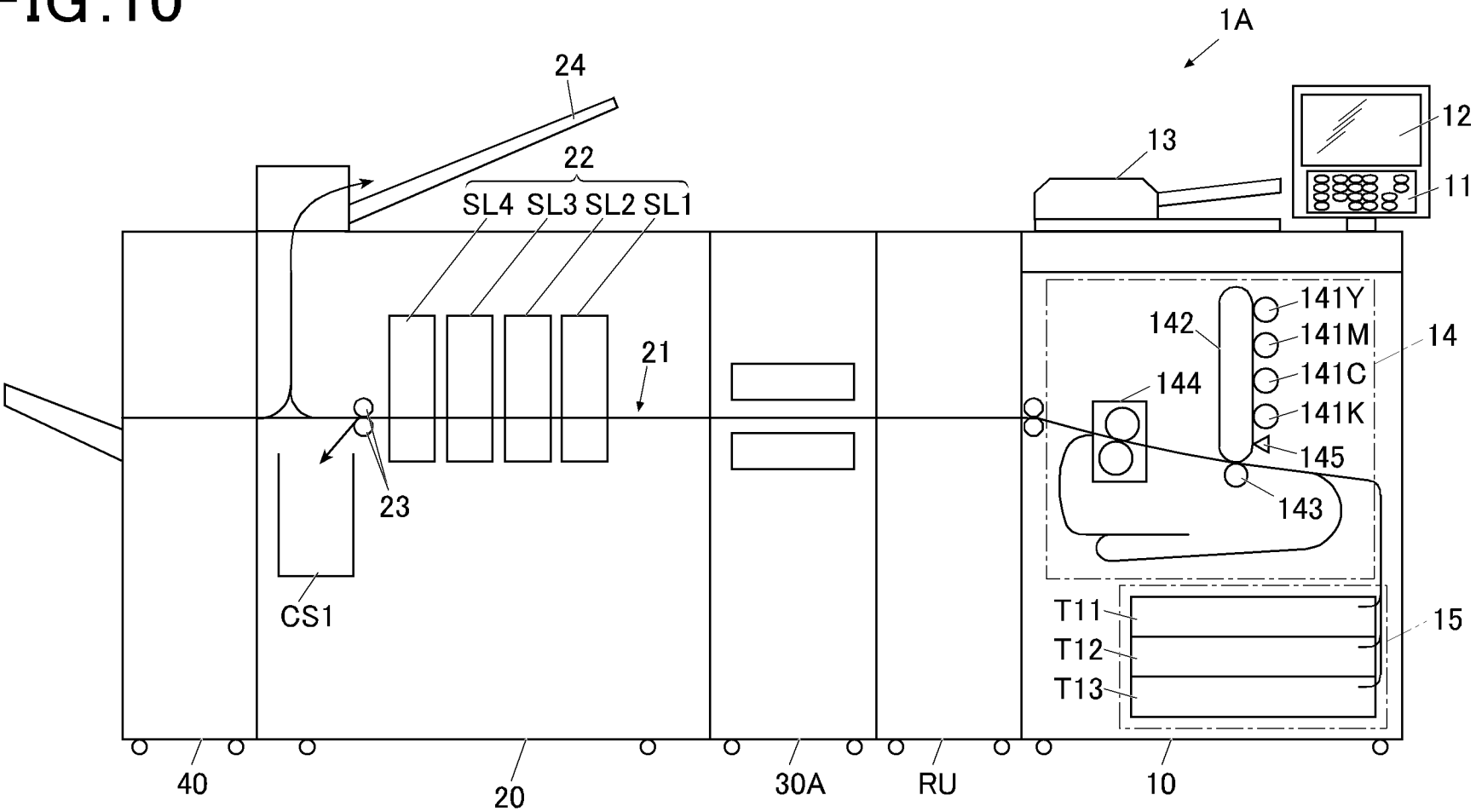
FIG. 10 is a diagram showing a schematic configuration of the image forming system according to modification 1.
Figure 11:
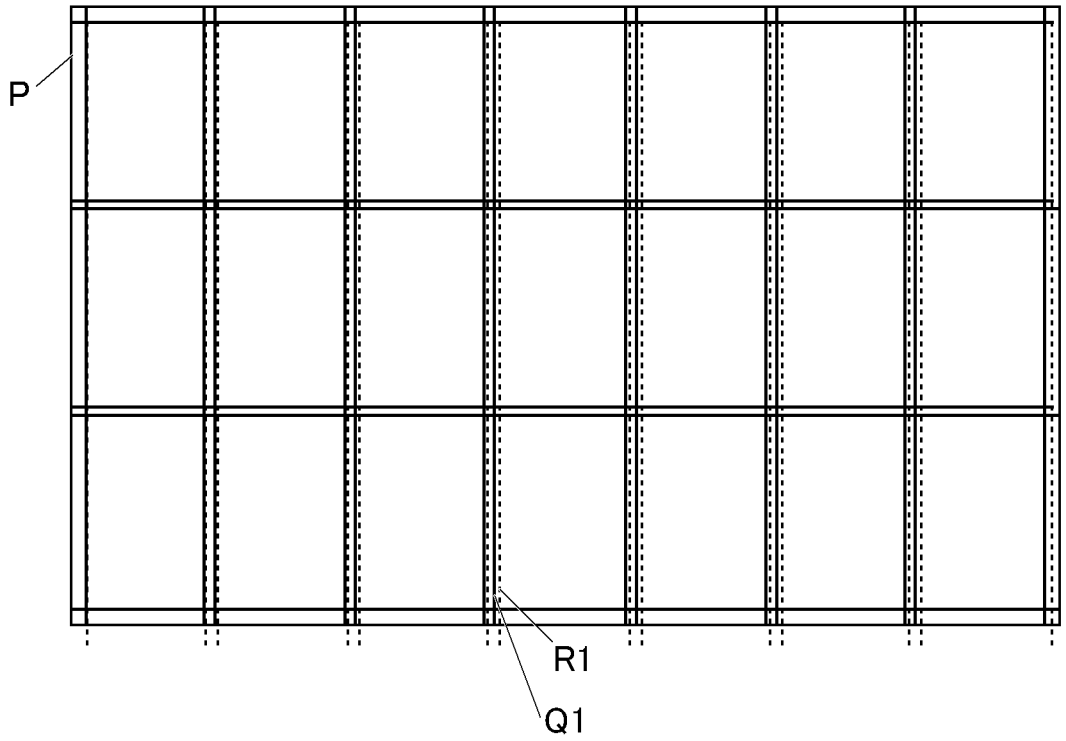
FIG. 11 is a diagram showing an example of how cutting positions are gradually displaced from the proper positions in conventional techniques.

For example, according to the above-described embodiment, the image reading apparatus 30 is provided downstream of the cutting apparatus 20 (cutter 22), but the configuration is not limited to the above. For example, as shown in FIG. 10, a configuration in which the image reading apparatus 30 is provided upstream of the cutting apparatus 20 (cutter 22) can be employed. In order to simplify the explanation, the same reference numerals are applied to the components that are the same as the embodiments and the detailed description is omitted.

As shown in FIG. 10, an image forming system 1A according to the modification 1 includes an image forming apparatus 10, a relay unit RU, an image reading apparatus 30A and a cutting apparatus 20 as a post-processing apparatus of the present invention, and a paper ejecting apparatus 40.

The image reading apparatus 30A is connected to be used before the cutting apparatus 20. The image reading apparatus 30A functions as a reader of the present invention.

In the image forming system 1A according to the modification 1, after the partial cutting paper (examination paper)

is created, the created examination paper is ejected outside the apparatus by the paper ejecting apparatus 40.

Next, the ejected examination paper is set again in the paper feeding apparatus. Here, other than the paper feeder 15 of the image forming apparatus 10, the paper feeding apparatus may be a paper feeder (PI inserter) included in the relay unit RU or the image reading apparatus 30A. When the paper feeder is included in the image reading apparatus 30A, the configuration is to be set so that the paper can be fed in the path before the reading is performed. When the examination paper is set again, in order to convey the paper stably, preferably, the paper is set so that the portion where the partial cutting is performed is not on the front side of the conveying direction.

Next, the examination paper set again is read by the image reading apparatus 30A and the paper is ejected outside the apparatus by the paper ejecting apparatus 40. The image forming controller 16 of the image forming apparatus 10 determines whether the cutting position of the examination paper is good or not based on the reading result read by the image reading apparatus 30A. When the cutting position of the examination paper is not good, the new correction adjustment value is created. The new correction adjustment value is employed and the cutting position of the paper is corrected (adjusted). After the cutting position is adjusted by the above process, the image forming controller 16 performs the job in which the adjustment of the cutting position is reflected.

With this, even in the image forming system 1A according to the modification 1, the present invention can be implemented.

Other Modifications

According to the above embodiments, after it is determined whether the cutting position of the paper in which the partial cutting is performed by the cutter 22 is good or not and it is determined that the cutting position is not good, the created new correction adjustment value is employed and the cutting position is adjusted. However, the process is not limited to the above. For example, only the determination of whether the cutting position of the paper in which the partial cutting is performed by the cutter 22 is good or not may be performed.

According to the above embodiments, the partial cutting is performed only in the main scanning direction or in both the main scanning direction and the sub-scanning direction, but the partial cutting is not limited to the above. For example, the partial cutting may be performed only in the sub-scanning direction.

Alternatively, in the existing correction adjustment value use selection screen G2 (see FIG. 8), in addition to the "use present adjustment value button B3", "use existing correction adjustment value B4", a "use default adjustment value button" can also be provided. When the user selects the "use default adjustment value button", the job is performed using the default adjustment value (adjustment value set manually in the adjustment mode).

The cutting apparatus 20 may be provided with the controller, and the controller may function as the determiner, the adjuster, the performer and the cutting controller of the present invention. With this, the present invention may be implemented by only the cutting apparatus 20 and the image reading apparatus 30 included in the post-processing apparatus. In this case, the cutting apparatus 20 may include a storage in order to store the adjustment value of the control parameters (cutting position, etc.) related to the business card creating job.

The detailed configuration and the detailed operation of the devices included in the image forming system can be suitably changed without leaving the scope of the present invention.

Although embodiments of the present invention have been described and illustrated in detail, the disclosed embodiments are made for purposes of illustration and example only and not limitation. The scope of the present invention should be interpreted by terms of the appended claims

What is claimed is:

1. A post-processing apparatus that performs post-processing on paper in which an image is formed, the apparatus comprising:

a paper cutter that cuts the paper in which the image is formed;

a reader that reads the paper cut by the paper cutter; and a hardware processor that determines whether a cutting position of the paper cut by the paper cutter is good or not based on a read result read by the reader, wherein the hardware processor determines whether the cutting position of the paper in which partial cutting is performed is good or not, the partial cutting being cutting a portion of the paper by the paper cutter.

2. The post-processing apparatus according to claim 1, wherein the reader is positioned downstream of the paper cutter.

3. The post-processing apparatus according to claim 1, wherein the hardware processor adjusts the cutting position based on a determined result.

4. The post-processing apparatus according to claim 3, wherein the hardware processor performs a job, and wherein when the job in which the paper is cut is set, the hardware processor determines whether the cutting position is good or not before the job is performed, the hardware processor adjusts the cutting position before the job is performed, and the hardware processor performs the job in which an adjustment of the cutting position is reflected.

5. The post-processing apparatus according to claim 4, wherein the job in which the paper is cut includes a business card creating job in which one sheet of paper is cut in a plurality of pieces in a conveying direction of the paper and a direction orthogonal to the conveying direction, and many pieces of cut paper are created in a same size to be ejected.

6. The post-processing apparatus according to claim 1, wherein the hardware processor controls the cutting of the paper by the paper cutter, and wherein when the job is set to cut the paper in both a conveying direction of the paper and a direction orthogonal to the conveying direction, the hardware processor controls the paper cutter to perform partial cutting in only either one of the above directions when partial cutting of the paper is performed by the paper cutter.

7. An image forming system comprising:

an image former that forms an image on paper; and a post-processing apparatus according to claim 1 that performs post-processing on the paper in which the image is formed by the image former.

* * * * *